US007086460B2

(12) United States Patent
Nguyen et al.

(10) Patent No.: US 7,086,460 B2
(45) Date of Patent: Aug. 8, 2006

(54) IN-SITU FILTERS, METHOD OF FORMING SAME AND SYSTEMS FOR CONTROLLING PROPPANT FLOWBACK EMPLOYING SAME

(75) Inventors: Philip D. Nguyen, Duncan, OK (US); Johnny A. Barton, Marlow, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 175 days.

(21) Appl. No.: 10/618,785

(22) Filed: Jul. 14, 2003

(65) Prior Publication Data

US 2005/0011648 A1 Jan. 20, 2005

(51) Int. Cl.
*E21B 43/02* (2006.01)

(52) U.S. Cl. ..... 166/51; 166/308

(58) Field of Classification Search ..... 166/280.1, 166/280.2, 276, 308.1; 507/924; 210/747, 210/170, 2, 496, 497.1; 264/109
See application file for complete search history.

(56) References Cited

U.S. PATENT DOCUMENTS 2,696,914 A * 12/1954 Conley ..... 210/492
3,965,686 A * 6/1976 Saito et al. ..... 405/43
5,330,005 A 7/1994 Card et al. ..... 166/280
5,439,055 A 8/1995 Card et al. ..... 166/280
5,501,274 A 3/1996 Nguyen et al. ..... 166/276
5,501,275 A 3/1996 Card et al. ..... 166/280
5,551,514 A 9/1996 Nelson et al. ..... 166/280
5,908,073 A * 6/1999 Nguyen et al. ..... 166/276
6,070,666 A * 6/2000 Montgomery ..... 166/308.1
6,172,011 B1 1/2001 Card et al. ..... 507/204
6,528,157 B1 * 3/2003 Hussain et al. ..... 428/325
6,752,208 B1 * 6/2004 Nguyen ..... 166/280.1

* cited by examiner

*Primary Examiner*—Frank S. Tsay
(74) *Attorney, Agent, or Firm*—Robert A. Kent; Baker Botts

(57) ABSTRACT

The present invention is directed to a method and apparatus for controlling the flowback of proppants that have been placed inside fractures of a subterranean formation. The apparatus is defined by a plurality of solid balls, which comprise compressed springs that are encapsulated in a mass of fibrous material and an aqueous soluble mixture of a filler material and an adhesive. In the method according to the present invention, the solid balls are mixed in a viscous slurry and injected into the fractures with the proppants. Over time the aqueous soluble mixture dissolves releasing the compressed springs to fill the openings of the fractures. The fibrous network and expanded springs, which remain, act as a filter or screen to restrict the movement of the proppants from flowing back to the surface during production of the well.

30 Claims, 7 Drawing Sheets

IN-SITU FILTERS, METHOD OF FORMING SAME AND SYSTEMS FOR CONTROLLING PROPPANT FLOWBACK EMPLOYING SAME

BACKGROUND OF THE INVENTION

The present invention relates to a method and apparatus for forming in-situ filters in subterranean formations, and more particularly, to an improved method and mechanical apparatus for controlling the flowback of proppants that have been placed inside fractures in the subterranean formation.

Transport of particulate solids during the production of hydrocarbons from a subterranean formation is a continuing problem. The transported solids can erode or cause significant wear in the hydrocarbon production equipment used in the recovery process. The solids also can clog or plug the wellbore thereby limiting or completely stopping fluid production. Further, the transported particulates must be separated from the recovered hydrocarbons adding further expense to the processing. The particulates which are available for transport may be present due to an unconsolidated nature of a subterranean formation and/or as a result of well treatments placing particulates in a wellbore or formation, such as, by gravel packing or propped fracturing.

In the treatment of subterranean formations, it is common to place particulate materials as a filter medium and/or a proppant in the near wellbore area and in fractures extending outwardly from the wellbore. In fracturing operations, proppant is carried into fractures created when hydraulic pressure is applied to these subterranean rock formations to a point where fractures are developed. Proppant suspended in a viscosified fracturing fluid is carried outwardly away from the wellbore within the fractures as they are created and extended with continued pumping. Upon release of pumping pressure, the proppant materials remain in the fractures holding the separated rock faces in an open position forming a channel for flow of formation fluids back to the wellbore.

Proppant flowback is the transport of proppants back into the wellbore with the production of formation fluids following fracturing. This undesirable result causes undue wear on production equipment, the need for separation of solids from the produced hydrocarbons and occasionally also decreases the efficiency of the fracturing operation since the proppant does not remain within the fracture and may limit the width or conductivity of the created flow channel. Proppant flowback often may be aggravated by what is described as "aggressive" flowback of the well after a stimulation treatment. Aggressive flowback generally entails flowback of the treatment fluid at a rate of from about 0.001 to about 0.1 barrels per minute (BPM) per perforation of the treatment fluids which were introduced into the subterranean formation. Such flowback rates accelerate or force closure of the formation upon the proppant introduced into the formation. The rapid flowrate can result in large quantities of the proppant flowing back into the wellbore before closure occurs or where inadequate bridging within the formation occurs. The rapid flowback is highly desirable for the operator as it returns a wellbore to production of hydrocarbons significantly sooner than would result from other techniques.

Currently, the primary means for addressing the proppant flowback problem is to employ resin-coated proppants or resin consolidation of the proppant which are not capable of use in aggressive flowback situations. Further, the cost of resin-coated proppant is high, and is therefore used only as a tail-in in the last five to twenty five percent of the proppant placement. Resin-coated proppant is not always effective since there is some difficulty in placing it uniformly within the fractures and, additionally, the resin coating can have a deleterious effect on fracture conductivity. Resin coated proppant also may interact chemically with common fracturing fluid crosslinking systems such as guar or hydroxypropylguar with organo-metallics or borate crosslinkers. This interaction results in altered crosslinking and/or break times for the fluids thereby affecting placement. Another means showing reasonable effectiveness has been to gradually release fracturing pressure once the fracturing operation has been completed so that fracture closure pressure acting against the proppant builds slowly allowing the proppant particles to stabilize before flowback of the fracturing fluid and the beginning of hydrocarbon production. Such slow return is undesirable, however, since it reduces the production from the wellbore until the treatment fluid is removed.

In unconsolidated formations, it is common to place a filtration bed of gravel in the near-wellbore area in order to present a physical barrier to the transport of unconsolidated formation fines with the production of hydrocarbons. Typically, such so-called "gravel packing operations" involve the pumping and placement of a quantity of gravel and/or sand having a mesh size between about 10 and 60 mesh on the U.S. Standard Sieve Series into the unconsolidated formation adjacent to the wellbore. It is sometimes also desirable to bind the gravel particles together in order to form a porous matrix through which formation fluids can pass while straining out and retaining the bulk of the unconsolidated sand and/or fines transported to the near wellbore area by the formation fluids. The gravel particles may constitute a resin-coated gravel which is either pre-cured or can be cured by an overflush of a chemical binding agent once the gravel is in place. It has also been known to add various hardenable binding agents or hardenable adhesives directly to an overflush of unconsolidated gravel in order to bind the particles together.

U.S. Pat. Nos. 5,330,005, 5,439,055 and 5,501,275 disclose a method for overcoming the difficulties of resin coating proppants or gravel packs by the incorporation of a fibrous material in the fluid with which the particulates are introduced into the subterranean formation. The fibers generally have a length ranging upwardly from about 2 millimeters and a diameter of from about 6 to about 200 microns. Fibrillated fibers of smaller diameter also may be used. The fibers are believed to act to bridge across constrictions and orifices in the proppant pack and form a mat or framework which holds the particulates in place thereby limiting particulate flowback. The fibers typically result in a 25 percent or greater loss in permeability of the proppant pack that is created in comparison to a pack without the fibers. While this technique may function to limit some flowback, it fails to secure the particulates to one another in the manner achieved by use of resin coated particulates.

U.S. Pat. No. 5,551,514 discloses a method for sand control that combines resin consolidation and placement of a fibrous material in intimate mixture with the particulates to enhance production without a gravel pack screen.

U.S. Pat. No. 5,501,274 discloses a method for reducing proppant flowback by the incorporation of thermoplastic material in particulate, ribbon or flake form with the proppant. Upon deposition of the proppant and thermoplastic material in the formation, the thermoplastic material softens and causes particulates adjacent the material to adhere to the thermoplastic creating agglomerates. The agglomerates then bridge with the other agglomerates and other particulates to prevent flowback from the formation.

SUMMARY OF THE INVENTION

The present invention provides methods and apparatuses for controlling the flowback of proppants that have been placed inside fractures of subterranean formations, which meet the needs described above and overcome the deficiencies of the prior art.

In one embodiment of the present invention, a method of forming an in-situ filter for controlling flowback of proppants injected into a fracture of a subterranean formation is provided. The method includes the step of injecting an expandable member into the fracture. Prior to injecting the expandable member into the fracture, the expandable member is compressed and inserted into the center of a mass of a fibrous network. The compressed structure is then placed inside of a mold cavity. An aqueous soluble mixture containing a filler material and adhesive is then injected into the mold cavity and allowed to cure until it forms a solid structure, which encapsulates the expandable member. The solid structure containing the expandable member is then removed from the mold cavity and ready for injection into the fracture. The encapsulated compressed expandable member is preferably mixed in a proppant slurry prior to being injected into the fracture. After the expandable member has been injected into the fracture, the soluble mixture making up the solid structure dissolves over time leaving a network of fibrous material and the expandable members, which act as a filter or a screen to restrict movement of the proppants during production.

In another embodiment, the present invention is directed to an in-situ filter for controlling flowback of proppants formed in a fracture of a subterranean formation, which comprises a network of fibrous material and a plurality of interspersed expandable members. Preferably, the expandable member is a spring, e.g., a torsion spring, compression spring, open coil spring, helical spring or clock spring. The encapsulated compressed expandable member can be formed into a number of different configurations, including, e.g., a solid ball having a spherical or elliptical shape or a solid structure having a generally bird or shuttlecock configuration.

In yet another embodiment, the present invention provides a system for controlling flowback of proppants injected into a fracture of a subterranean formation. The system comprises a plurality of the encapsulated compressed expandable members placed in the fracture adjacent to a wellbore formed within the subterranean formation. A fibrous material and aqueous soluble filler material are encapsulated with the compressed expandable members. As the soluble material dissolves, the compressed expandable members are released from the encapsulated state and expand to form an in-situ filter in the fracture adjacent to the wellbore.

Other and further objects, features and advantages of the present invention will be readily apparent to those skilled in the art upon a reading of the description of preferred embodiments which follows.

BRIEF DESCRIPTION OF THE DRAWINGS

The present invention is better understood by reading the following description of non-limitative embodiments with reference to the attached drawings, which are briefly described as follows.

It is to be noted, however, that the appended drawings illustrate only typical embodiments of this invention and are therefore not to be considered limiting of its scope, as the invention may admit to other equally effective embodiments.

DETAILED DESCRIPTION OF THE INVENTION

Figure 1:
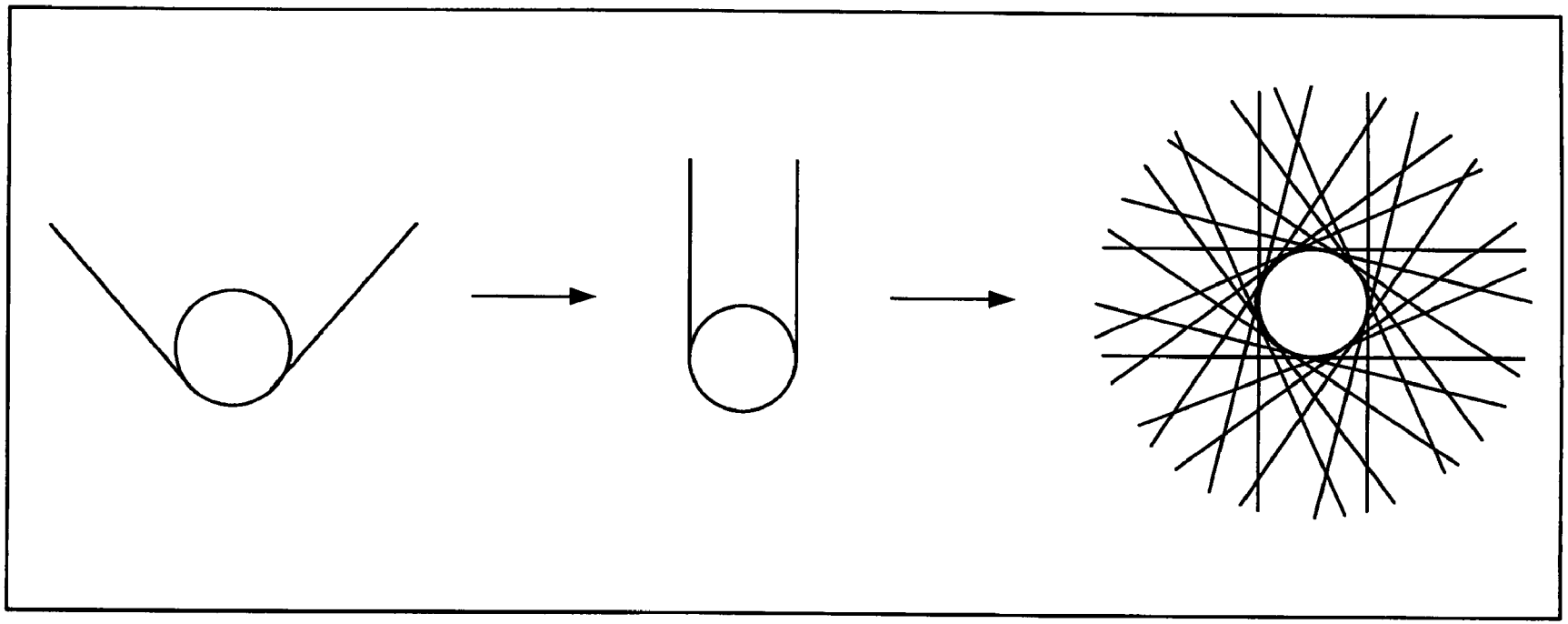
FIG. 1 illustrates a torsion spring in accordance with the present invention shown in its uncompressed state, compressed state and joined with other like torsion springs to form an expandable structure in accordance with the present invention.
Figure 2:
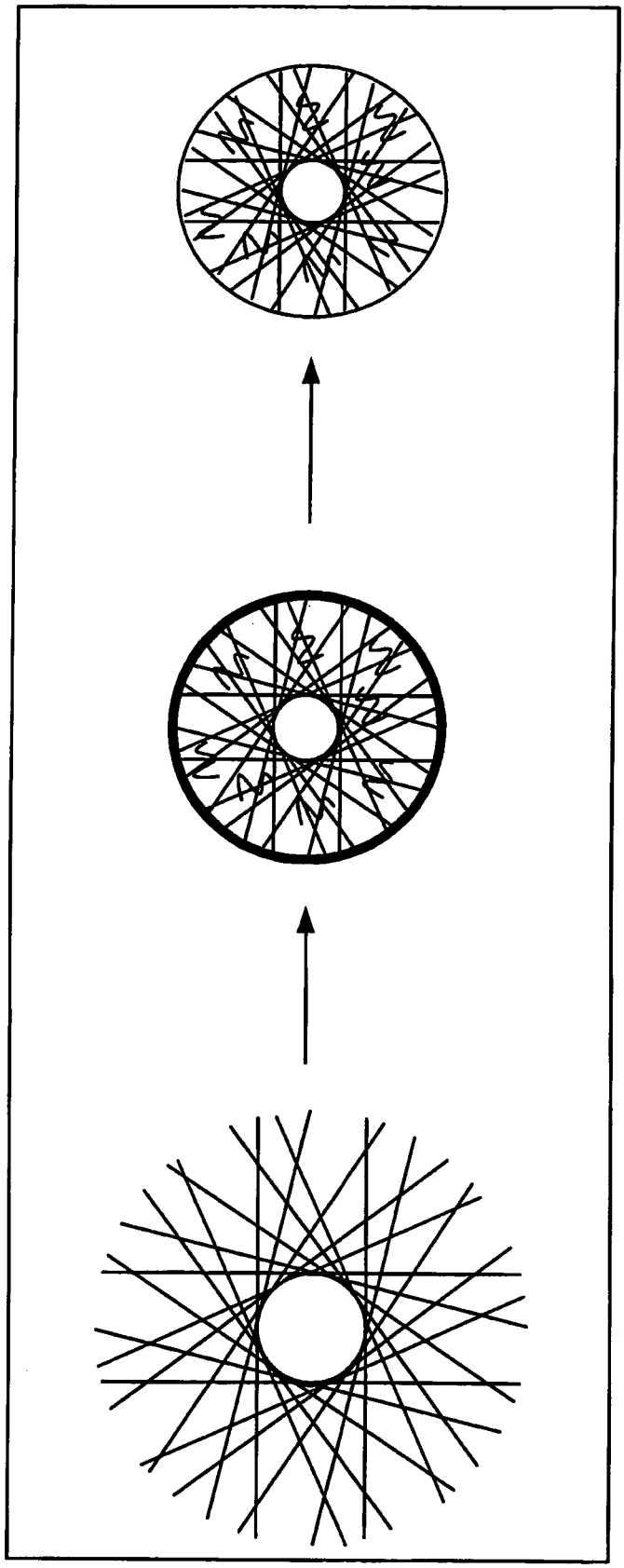
FIG. 2 illustrates the steps carried out in forming a solid ball, which encapsulates a plurality of compressed torsion springs in accordance with one embodiment of the present invention.

The details of the present invention will now be discussed with reference to the FIGS. Turning to FIGS. 1 and 2, the steps of forming one embodiment of an in-situ filter according to the present invention is illustrated. In the first step, a number of torsion springs prepared from metal wire are uniformly compressed and inserted into the center of a mass of fibrous network such as stainless steel wool or composite fibrous sponge. The compressed structure is then placed inside a mold, as shown in FIG. 2.

Next, an aqueous soluble mixture of filler and adhesive is injected into the mold cavity to encapsulate the compressed springs. After curing, the contents inside the mold are transformed into a solid ball. This solid ball can be spherical or elliptical in shape. Other shapes are also possible as those of ordinary skill in the art will appreciate. Preferably, the ball has a diameter smaller than that of a fracture to allow it to enter the fracture.

Figure 3:
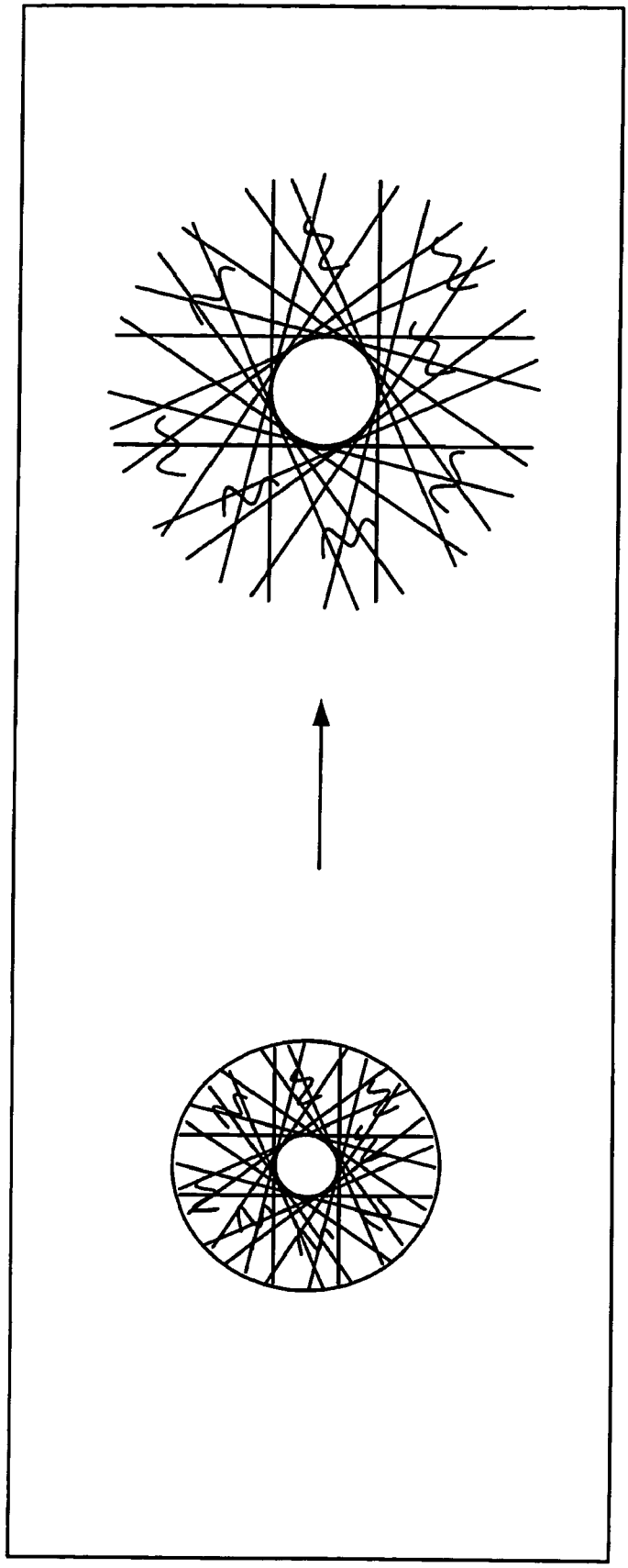
FIG. 3 illustrates expansion of a plurality of encapsulated torsion springs once an aqueous soluble mixture used to encapsulate the torsion springs has dissolved.

Next, a number of these soluble solid balls are mixed with a slurry containing the proppants, which are to be restrained. The slurry mixture containing the solid balls and proppants is then pumped down hole during the fracturing treatment step, preferably during the tail-in of proppant stage. Ideally, the solid balls are injected into the fractures adjacent to the wellbore. The solid balls then begin to dissolve. As this happens, the springs re-expand so that the entire fibrous structure is enlarged (as shown in FIG. 3) to cause it to be bridged within the fracture. After the filler material dissolves, the remaining fibrous network and springs act as a filter or a screen to restrict the movement of proppant from producing back during production of the well.

The torsion springs formed into the soluble solid balls can be formed of a number of different materials, including, e.g., shape memory alloys (such as Nitinol) and shape memory polymers. Shape memory polymers are known to return to their original shape after being exposed to certain temperatures. As those of ordinary skill in the art will appreciate, other types of springs may be used in place of a torsion spring in the embodiment shown in FIGS. 1–3. For example, a compression spring, an open coil spring, a helical spring or other similar device may be substituted for a torsion spring.

The aqueous soluble filler material preferably mainly comprises glycerin, wintergreen oil, oxyzolidine oil (animal, vegetable or mineral) and water. The adhesive is preferably formed mainly of collagen. As those of ordinary skill in the art will appreciate, other compositions may be employed in forming the filler material, such as aliphatic polyesters, polylactic acid, poly(lactides), poly(anhydrides) and adhesive. Appropriate compositions of filler and adhesive are mixed to form a viscous slurry suitable for injection molding. Preferably, the balls are manufactured to have a specific gravity of about 0.5 to 2.0. More preferably, the balls are manufactured to have a specific gravity of about 1.1 to 1.2. Light weight beads are optionally embedded with the filler material to help adjust the specific gravity of the balls. The balls can be made lighter by using, e.g., pearlite, or heavier by using, e.g., sand.

Figure 4:
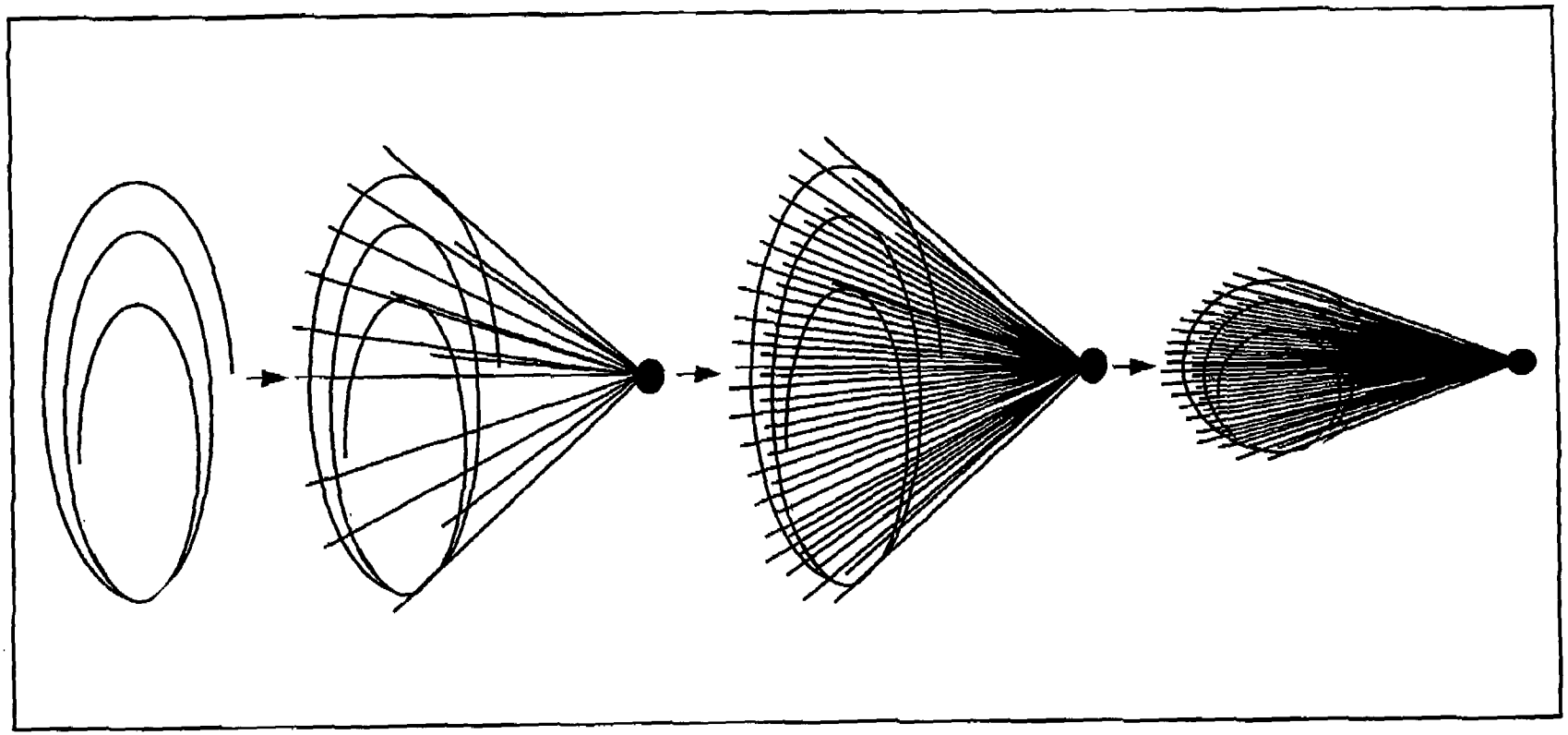
FIG. 4 illustrates the steps in forming an expandable filter structure in the form of a shuttlecock in accordance with another embodiment of the present invention.
Figure 5:
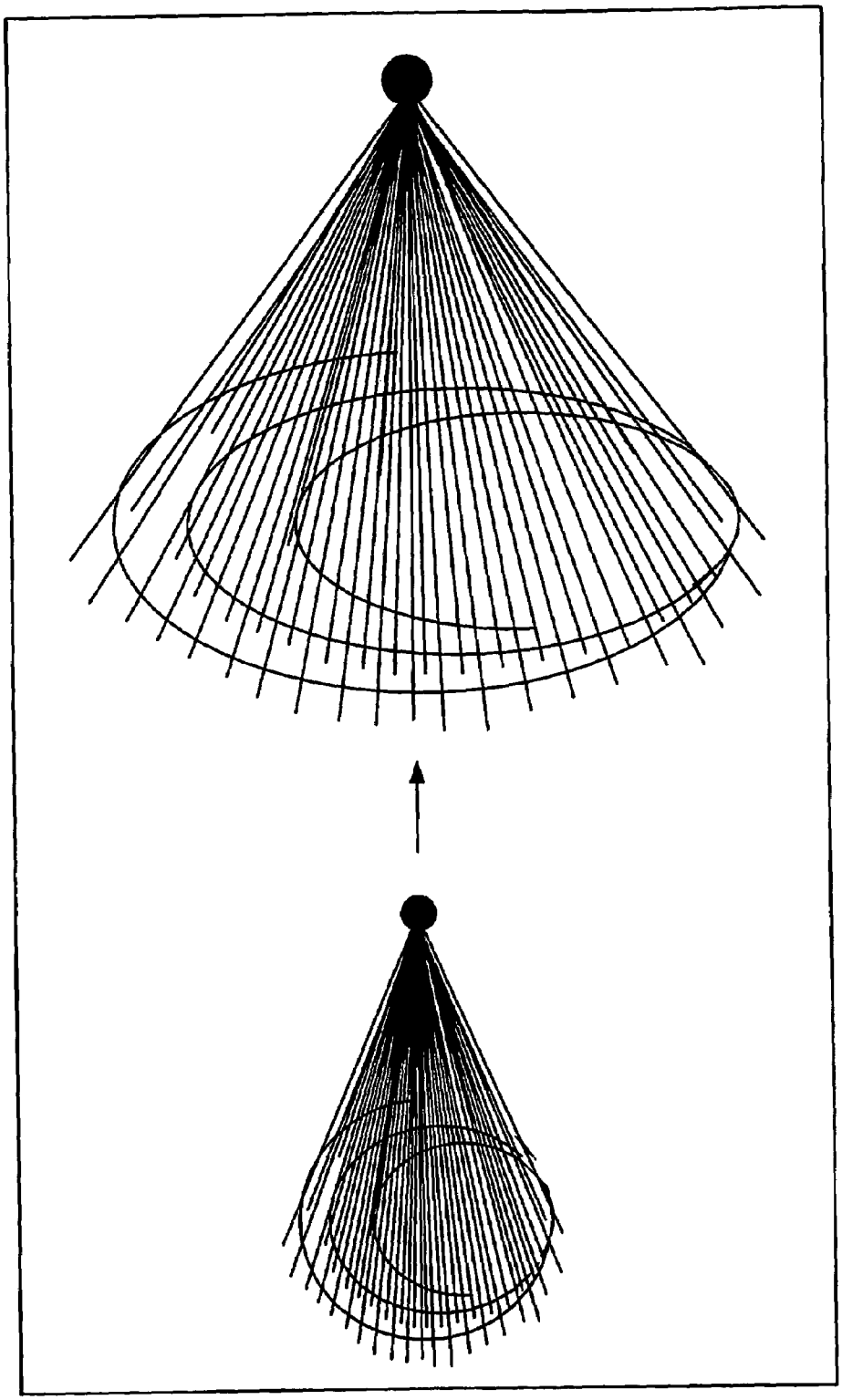
FIG. 5 illustrates expansion of the expandable filter structure shown in FIG. 4 once the mixture of filler material and adhesive used to encapsulate the clock spring used in forming this embodiment has dissolved.

An alternate embodiment of the present invention is shown in FIG. 4. This embodiment employs a clock spring to form an expandable structure that has a configuration similar to that of a bird or shuttlecock of a badminton. This expandable structure is formed as follows. First, one end of a plurality of segments of stainless metal wires or composite polymer strands is welded, soldered or otherwise secured to the outer coil of the spring, as shown in the second drawing of FIG. 4. The other end of the segments is anchored together and attached to a heavy object, e.g., a ball formed of ceramic, bauxite, or metal. In one version of this embodiment, a flexible filter sheath (e.g., a stainless metal woven wire cloth) with mesh sizes greater than 60-mesh is attached to the spring and wires.

Next, the expandable structure is wound to significantly reduce the overall diameter of the spring, as shown in the fourth drawing of FIG. 4. A temperature-activated adhesive is then applied to hold the structure in this compressed configuration. Preferably, the structure has a diameter smaller than that of a fracture to allow it to enter the fracture. At a high temperature (e.g., preferably higher than 160° F.), the adhesive melts allowing the spring to unwind thereby expanding the entire structure.

In an alternative version of the embodiment shown in FIG. 4, a curable and aqueous soluble filler material is used in place of the temperature-activated adhesive to encapsulate the expandable structure while it is in the compressed state. After curing, the contents are transformed into a rigid structure just as in the previously described embodiment. After the filler material dissolves, the spring unwinds and expands the entire structure. The use of an aqueous soluble filler material alone in place of an aqueous soluble mixture of filler and adhesive may also be used in the embodiment shown in FIGS. 1–3 described above.

The expandable structures of FIG. 4 are mixed with a slurry containing the proppants, which are to be restrained. The slurry mixture containing the expandable shuttlecock-shaped structure and proppants is then pumped down hole during the fracturing treatment, preferably during the tail-in of proppant stage. Ideally, the expandable shuttlecock-shaped structures are placed in the fractures adjacent to the wellbore. Preferably, the expandable structures settle in the fractures with the heavy object side being wedged deeper into the fracture than the clock spring side.

As the soluble material and/or adhesive dissolves, the compressed structure re-expands under downhole conditions. More specifically, as the spring unwinds, the entire structure enlarges to cause it to be bridged within the fracture. The free ends of the wires help to grip the fracture. As a result, the spring, wire segments, and filter sheath if employed, together act as a filter or a screen to restrict the movement of the proppants and prevent them from producing back during production of the well.

Figure 6:
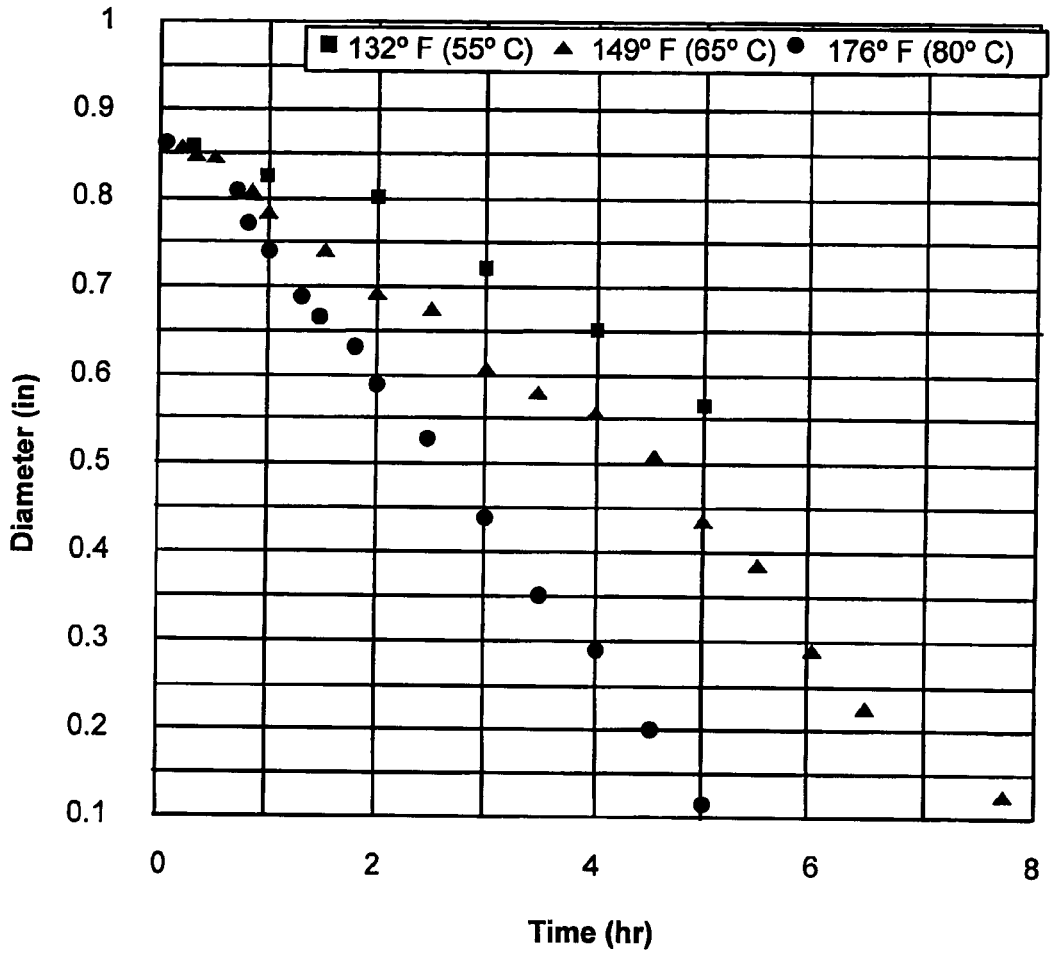
FIG. 6 shows the dissolution rate of solid balls encapsulating compression springs formed using a mid-range temperature aqueous soluble mixture as a function of time at different temperatures.
Figure 7:
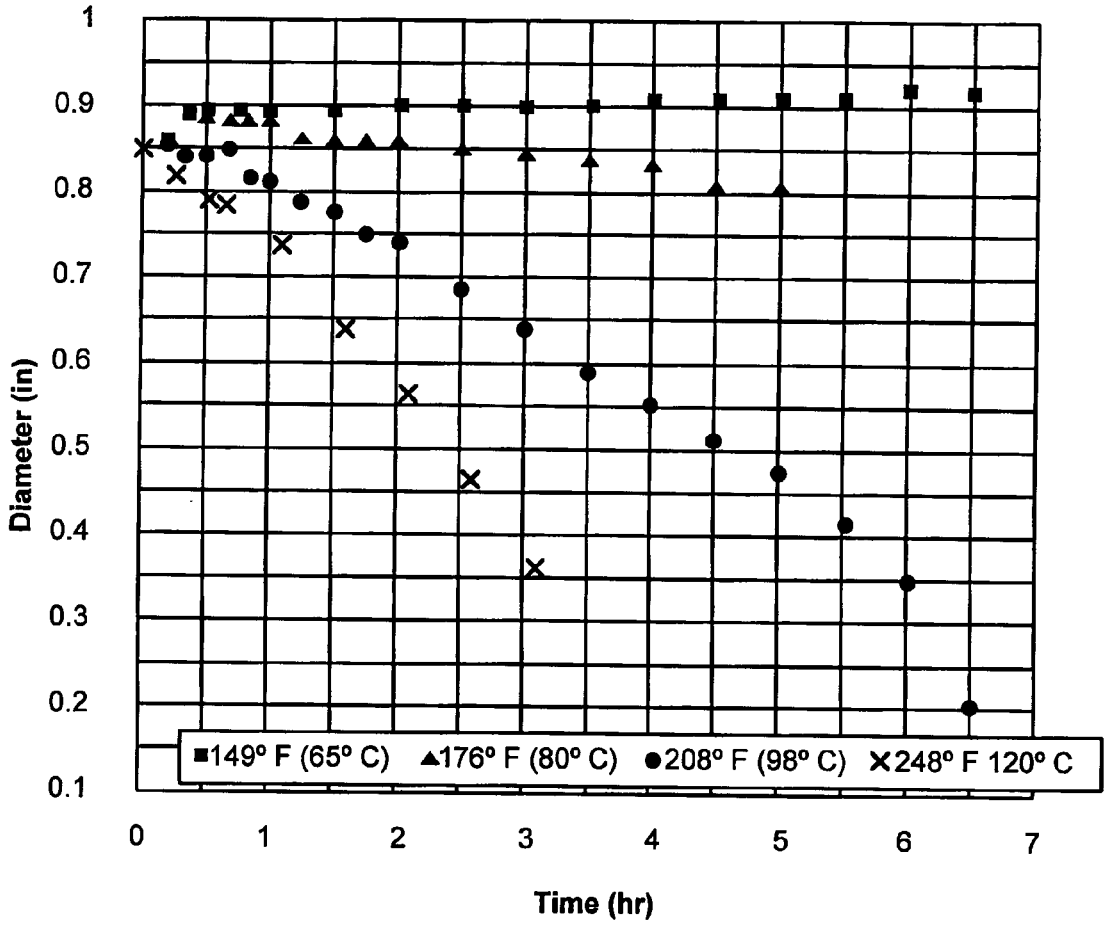
FIG. 7 shows the dissolution rate of solid balls encapsulating compression springs formed using a high-range temperature aqueous soluble mixture as a function of time at different temperatures.

FIGS. 6 and 7 illustrate the dissolution rate of a ball (i.e., ball diameter) as a function of time at various down hole temperatures. As an example, the degradable balls known as BioBalls, are currently commercially available through Santrol of Fairmount Minerals (Chardon, Ohio). The BioBalls are composed of organic compound collagen, the most fibrous protein found in living organisms. As a ball is exposed to temperature and time, the dissolution of the material decreases the diameter of the ball. The higher the temperature, the diameter becomes smaller faster. FIG. 6 graphs the dissolution rates for mid-range temperature BioBalls (132° F. to 176° F.). Similarly, FIG. 7 graphs the dissolution rates for high-range temperature BioBalls (149° F. to 248° F.).

Therefore, the present invention is well adapted to carry out the objects and attain the ends and advantages mentioned as well as those that are inherent therein. While numerous changes may be made by those skilled in the art, such changes are encompassed within the spirit of this invention as defined by the appended claims.

What is claimed is:

1. A method of forming an in-situ filter for controlling flowback of proppants injected into a fracture of a subterranean formation comprising the step of injecting a spring into the fracture.

2. The method of forming an in-situ filter according to claim 1 further comprising the steps of compressing the spring and inserting it into a mass of a fibrous network before the step of injecting the spring into the fracture.

3. The method of forming an in-situ filter according to claim 2 further comprising the step of placing the compressed spring and fibrous network into a mold cavity after the steps of compressing the spring and inserting it into the mass of the fibrous network.

4. The method of forming an in-situ filter according to claim 3 further comprising the step of injecting an aqueous soluble mixture into the mold cavity after the step of placing the compressed spring and fibrous network into the mold cavity.

5. The method of forming an in-situ filter according to claim 4 further comprising the step of curing the aqueous soluble mixture until it forms a solid structure, which encapsulates the compressed spring and fibrous network, after the step of injecting an aqueous soluble mixture into the mold cavity.

6. The method of forming an in-situ filter according to claim 5 further comprising the step of removing the solid structure containing the compressed spring and fibrous network from the mold cavity after the step of curing the aqueous soluble mixture until it forms the solid structure.

7. The method of forming an in-situ filter according to claim 6 further comprising the step of mixing the solid structure containing the compressed spring and fibrous network with a proppant slurry after the step of removing the solid structure containing the compressed spring and fibrous network from the mold cavity.

8. The method of forming an in-situ filter according to claim 7 further comprising the step of injecting the mixture of the solid structure containing the compressed spring and fibrous network and the proppant slurry into the fracture after the step of mixing the solid structure containing the compressed spring and fibrous network with the proppant slurry.

9. The method of forming an in-situ filter according to claim 8 further comprising the step of dissolving the soluble mixture forming the solid structure after the spring has been injected into the fracture thereby releasing the spring from the compressed state, which together with the fibrous network form the in-situ filter after the step of injecting the mixture of the solid structure containing the compressed spring and fibrous network and the proppant slurry into the fracture.

10. An in-situ filter for controlling flowback of proppants comprising:

a network of fibrous material; and a plurality of interspersed springs wherein the springs are clock springs and a plurality of elongated members are attached at one end to each clock spring.

11. The in-situ filter according to claim 10 wherein the fibrous network comprises materials selected from the group consisting of stainless steel wool, a composite fibrous sponge and combinations thereof.

12. The in-situ filter according to claim 10 wherein another end of the plurality of elongated members are anchored by, and attached to, a ball.

13. The in-situ filter according to claim 12 further comprising a flexible filter sheath attached to each spring and associated elongated members.

14. The in-situ filter according to claim 10 wherein the springs comprise at least one of the following: a stainless steel wire or a composite polymer.

15. The in-situ filter according to claim 13 wherein the flexible filter sheath is formed of a stainless woven wire cloth having a mesh size greater than 60-mesh.

16. A system for controlling flowback of proppants injected into a fracture of a subterranean formation comprising a plurality of encapsulated compressed springs placed in the fracture adjacent to a wellbore formed within the subterranean formation.

17. The system for controlling flowback of proppants according to claim 16 wherein a mass of fibrous material is encapsulated with the compressed springs.

18. The system for controlling flowback of proppants according to claim 17 wherein an aqueous soluble mixture comprising a filler material is encapsulated with the compressed springs.

19. The system for controlling flowback of proppants according to claim 18 wherein the filler material comprises glycerin, wintergreen oil, oxyzolidine oil and water.

20. The system for controlling flowback of proppants according to claim 18 wherein the aqueous soluble mixture further comprises an adhesive.

21. The system for controlling flowback of proppants according to claim 20 wherein the adhesive comprises collagen.

22. The system for controlling flowback of proppants according to claim 18 wherein the aqueous soluble mixture dissolves under downhole conditions causing the compressed springs to be released from the encapsulated state and expand to form an in-situ filter in the fracture adjacent to the wellbore.

23. The system for controlling flowback of proppants according to claim 22 wherein the aqueous soluble mixture dissolves in approximately 3 to 8 hours.

24. The system for controlling flowback of proppants according to claim 22 wherein the aqueous soluble mixture dissolves in temperatures greater than approximately 55° C.

25. The system for controlling flowback of proppants according to claim 16 wherein each of the compressed springs comprises at least one spring selected from the group consisting of a torsion spring, a compression spring, an open coil spring, a helical spring and a clock spring.

26. The system for controlling flowback of proppants according to claim 25 wherein the springs are clock springs and a plurality of elongated members are attached at one end to each clock spring.

27. The system for controlling flowback of proppants according to claim 26 wherein the other end of the plurality of elongated members are anchored by, and attached to, a ball.

28. The system for controlling flowback of proppants according to claim 27 further comprising a flexible filter sheath attached to each spring and associated elongated members.

29. The system for controlling flowback of proppants according to claim 26 wherein the elongated members are formed of a material selected from the group of a stainless steel wire and a composite polymer.

30. The system for controlling flowback of proppants according to claim 28 wherein the flexible filter sheath is formed of a stainless woven wire cloth having a mesh size greater than 60-mesh.

* * * * *